US006323562B1

(12) United States Patent
Renner et al.

(10) Patent No.: US 6,323,562 B1
(45) **Date of Patent: *Nov. 27, 2001**

(54) CIRCUIT FOR A LATCHING RELAY

(75) Inventors: Stefan Renner, Weissach; Claus Kramer, Besigheim; Karl-Otto Schmidt, Keltern; Uwe Daurer, Ludwigsburg, all of (DE)

(73) Assignee: Robert Bosch GmbH, Stuttgart (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/355,007

(22) PCT Filed: Nov. 6, 1997

(86) PCT No.: PCT/DE97/02599

§ 371 Date: Jul. 21, 1999

§ 102(e) Date: Jul. 21, 1999

(87) PCT Pub. No.: WO98/32966

PCT Pub. Date: Jul. 30, 1998

(30) Foreign Application Priority Data

Jan. 28, 1997 (DE) ..... 197 02 932

(51) Int. Cl.[7] ..... F02N 11/00; H02P 9/04

(52) U.S. Cl. ..... 290/38 A; 290/38 B; 290/38 C; 290/38 R; 290/36 R; 290/37 R

(58) Field of Search ..... 290/38 A, 38 B, 290/38 R, 40 A–40 I; 123/179; 74/7 A

(56) References Cited

U.S. PATENT DOCUMENTS

| | | | | |
|---|---|---|---|---|
| 3,863,077 | * | 1/1975 | Bienkowski | 290/38 |
| 4,418,289 | * | 11/1983 | Mortensen | 307/142 |
| 4,455,490 | * | 6/1984 | Giardini et al. | 290/38 A |
| 4,748,337 | * | 5/1988 | Road et al. | 290/31 |
| 4,862,009 | * | 8/1989 | King | 290/22 |
| 4,916,327 | * | 4/1990 | Cummins | 290/38 R |
| 4,949,684 | * | 8/1990 | Gohara | 123/179 |
| 5,325,827 | * | 7/1994 | Fasola | 123/179.3 |
| 5,383,428 | | 1/1995 | Fasola | 123/179 |
| 5,622,148 | * | 4/1997 | Xue et al. | 123/179.25 |
| 5,642,696 | * | 7/1997 | Matsui | 123/179.1 |

FOREIGN PATENT DOCUMENTS

| | | | | |
|---|---|---|---|---|
| 195 03 536 A | | 8/1996 | (DE) . | |
| 61101672 | * | 5/1986 | (JP) | 290/38 A |

* cited by examiner

*Primary Examiner*—Elvin Enad
(74) *Attorney, Agent, or Firm*—Michael J. Striker

(57) ABSTRACT

A circuit arrangement for an engagement relay of a starter mechanism of an internal combustion engine, for bringing two gearwheels in engagement, the circuit arrangement having a switching element which reduces a relay current after a first time period before meshing of the two gear wheels to a determined current value during a second time period, the switching element being formed as a controlling and regulating device which increases a relay current to a predetermined value to a third time period which starts when one gear wheel reaches the other gear wheel.

11 Claims, 8 Drawing Sheets

CIRCUIT FOR A LATCHING RELAY

SUMMARY OF THE INVENTION

The invention is directed to a circuit arrangement for an engagement relay of a starter mechanism of an internal combustion engine, which engagement relay brings two gearwheels in engagement.

A circuit arrangement for an engagement relay is known from DE 195 035 36, wherein the circuit arrangement has a controlling and/or regulating circuit which influences the operating current of an auxiliary relay. The auxiliary relay in the prior art serves to decouple the current flowing across the relay coil of the engagement relay during the starting process of an internal combustion engine from an ignition starter switch or driving switch. This is carried out in that the current needed for the engagement relay, which can amount to about 80 to 100 A, is switched by the auxiliary relay. For this purpose, the auxiliary relay requires an operating current which is smaller compared with the engagement relay current and which can be switched with this construction by the ignition starter switch or driving switch.

Due to the controlled or regulated current, it is possible to reduce the overall dimensions of the auxiliary relay.

A disadvantage in the construction known from the prior art consists in that only the operating current of the auxiliary relay can be controlled or regulated. There is no provision for regulating the current of the engagement relay. Consequently, during the starting process for the internal combustion engine, the engagement relay always operates at a constant current which is so dimensioned that the engagement relay develops a sufficient magnetic force in every instance. A substantial disadvantage of the known construction results from a hyperbolic force-path characteristic of a relay, namely, as the air gap becomes smaller an unnecessarily high acceleration of the engagement relay armature is reached. Since the engagement relay armature moves the driving pinion of the starter mechanism axially by means of a lever mechanism, this also leads to a high acceleration of the driving pinion. During a starting process, if the driving pinion is so positioned relative to the gearwheel to be driven that two teeth of the respective gearwheels are directly opposite one another, the two gearwheels cannot be made to mesh with one another. If the driving pinion which is very highly accelerated by the engagement relay and lever mechanism meets the gearwheel to be driven, very high forces must be compensated when the two gearwheels meet. These high forces can result in complete destruction of the gear teeth.

Further, devices which rotate one gearwheel relative to another when two gearwheel teeth strike against one another are known in the prior art. These devices are known as meshing gear units. It is disadvantageous in this connection that the driving pinion which is moved relative to a gearwheel is accelerated very sharply by an engagement relay via a lever mechanism as was already mentioned. Consequently, there is a further increase in gearwheel wear due to the combination of high forces which are transmitted to the driving pinion via the engagement relay and the rotating movement which is brought about by the meshing gear unit because the two gearwheel elements rub against one another due to the force and rotating movement. This leads to the familiar "grinding" noise.

In another embodiment form known in the prior art, the starter motor of the starter mechanism takes over the task of the meshing gear unit. If the teeth of the driving pinion in this embodiment form strike the gearwheel to be driven, the motor of the starter mechanism is supplied with its nominal current, so that the driving pinion is quickly rotated relative to the gearwheel to be driven and meshes therewith. The force acting on the driving pinion due to the engagement relay combined with the high motor speed leads to extensive wear or even to its destruction as a result of the "grinding" of the gearwheel elements.

In vehicles which are provided for start-stop operation in the interests of reducing gasoline consumption and which consequently have a greater number of starting processes, the life of the starter mechanism would be short.

SUMMARY OF THE INVENTION

The invention is directed to a circuit arrangement for an engagement relay of a starter mechanism of an internal combustion engine, which engagement relay causes the engagement of two toothed gearwheels and comprises a controlling and regulating device that reduces a relay current after a first time period before the meshing of the two gearwheels to a determined current value during a second time period.

The circuit arrangement according to the invention has the advantage that the provided controlling and regulating device reduces the relay current after a first time period before the meshing of the two gearwheels to a predetermined current value during a second time period, resulting in smaller magnetic forces acting on the relay armature. Due to the hyperbolic force-path characteristic of the relay, an unnecessarily high acceleration of the driving pinion is prevented as the air gap between the relay armature and relay coil decreases and while the relay current decreases at the same time.

This results in reduced wear for the starter mechanism due to smaller forces acting when the gearwheel elements strike against one another, so that a longer life is achieved for the starter pinion and the gearwheel ring. The possible number of starts of this starter mechanism can accordingly be increased five-fold to ten-fold.

Further, a reduction in noise during the meshing of the driving pinion in the gearwheel to be driven is achieved by the circuit arrangement according to the invention. The noise reduction is carried out in that the starter motor of the starter mechanism rotates at a sharply reduced speed when the teeth strike against one another, so that the grinding of the two gearwheel elements is prevented.

A further advantage results in that the driving pinion is less highly accelerated during the second time period, wherein no high forces which rebound off the driving pinion take place when the driving pinion stops at a suitable pinion path limiting device, for example, a stop ring arranged on the rotor shaft. This means that the meshing process is reliably carried out in a "tooth-to-gap" position of the two gearwheels, so that the pinion is not thrown back in its engaging movement by large forces occurring when the pinion encounters the stop ring and, in this way, possibly disengaged or de-meshed again from the gearwheel to be driven.

In an advantageous construction of the invention, the controlling and regulating device controls or regulates the current of the engagement relay as well as the current of the starter motor during the engagement process by means of an individual final control stage. For this purpose, the relay winding is designed in such a way that the number of turns is reduced while the conductor cross section is increased at the same time. This can result in the same force-path characteristic of the relay as that in a standard relay;

however, for this purpose, the relay current must be increased to a current strength in the order of magnitude of 100 A to 150 A, wherein, of course, the relay current is controlled and regulated by the circuit arrangement according to the invention.

In this embodiment form, for example, in a series-wound motor, the relay is connected in series with the excitation winding or armature winding.

When the relay current during a starting process reaches a level that is needed for spinning the rotor, the relay current flows through the above-mentioned series connection of the relay winding and excitation winding or armature winding and the rotor is set in motion at a low speed. Due to the fact that the driving pinion is fitted to the rotor shaft so as to be fixed with respect to rotation relative to it, the driving pinion rotates relative to the gearwheel to be driven during the engagement process and can mesh in a gap between two teeth of the gearwheel to be driven.

Another advantageous construction of the invention results in an embodiment form which is characterized in that the relay current and the starter motor current can be regulated or controlled decoupled from one another, wherein the axial movement and rotating movement of the pinion can be decoupled with respect to time as well as with respect to forces. Accordingly, it is possible in an advantageous manner to apply a greater axial force for the engagement or meshing of the driving pinion with a simultaneous reduction in the driving torque of the rotor.

Further advantageous constructions of the invention follow from the subclaims.

DESCRIPTION OF PREFERRED EMBODIMENTS

A pre-engaged drive starter without additional gear-reduction or transmission stage is provided, by way of example, for the first and second embodiment example of the starter mechanism of an internal combustion engine. This means that the meshing of the driving pinion in the ring gear to be driven is carried out in the axial direction in a pre-engaged drive starter, wherein the driving pinion is guided so as to be displaceable on the rotor axis of the starter motor and the axial displacement simultaneously brings about the rotating movement of the pinion on the rotor shaft. This is carried out, for example, in the case of a mechanical meshing gear unit, by means of a coarse thread which is arranged on the rotor shaft surface and in which a driver engages, wherein the driver causes the rotating movement of the driving pinion due to the axial movement of the pinion because the rotational movement of the pinion which is arranged on the rotor shaft so as to be fixed with respect to rotation relative to it proceeds directly from the motor. In this construction of the preengaged drive starter without additional transmission stage by way of example, the driving pinion is arranged on the rotor axis so as to be displaceable, but is driven directly by the rotator shaft during the starting process, so that the pinion rotates at the same speed as the rotor of the starter motor.

The above-mentioned pre-engaged drive starter without additional transmission stage is assumed again for the third and fourth embodiment examples, but a mechanical meshing gear unit can be omitted in this case. This means that the driving pinion need not be rotated on the rotor axis during an engagement process.

Further, a series-wound motor is provided for the embodiment examples mentioned above; that is, an armature winding and an excitation winding of the starter motor are connected in series. Of course, embodiment forms with permanently-excited motor are also possible. Construction variants of the starter mechanism having an additional transmission stage which is arranged between the rotor axis and the driving pinion and which suitably steps down the motor speed to a different speed at which the pinion is driven are also possible. Naturally, there are also other possible embodiment forms for the starter mechanism. Accordingly, it is clear that the circuit arrangement according to the invention is applicable to all common types of starter.

Figure 1:
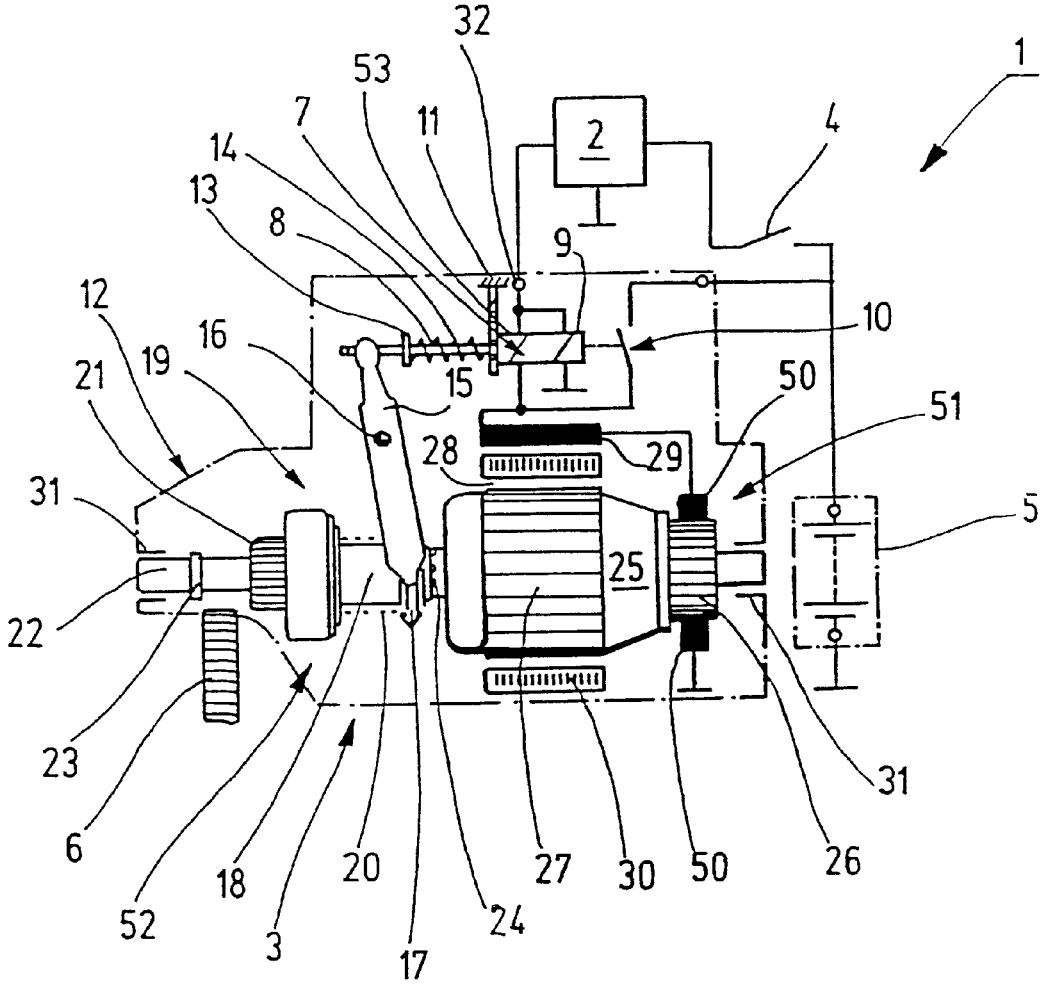
FIG. 1 shows a starter mechanism of an internal combustion engine in connection with a first embodiment example of the circuit arrangement.

FIG. 1 shows a starter mechanism 1 comprising a control device 2 which is a component part of a complex starting process controlling device, not shown, and a starter 3 of an internal combustion engine which is shown herein only by way of a ring gear 6 to be driven. Also shown are an ignition starter switch or driving switch—designated hereinafter as starter switch 4, and a battery 5 of a motor vehicle, not shown.

The starter 3 comprises an engagement relay 7, a starter motor 51, a meshing gear unit 52 and a contact bridge 10.

The engagement relay 7 comprises a relay armature 8, a pull-in winding 9 and a hold-in winding 53. The contact bridge 10 can be actuated via the engagement relay. The engagement relay 7 is held inside a housing 12 of the starter 3 by a web or crosspiece 11. A return spring 14 is provided between the crosspiece 11 and a ring 13 on a relay armature 8. An engaging lever 15 is articulated at the end of the relay armature 8. The engaging lever 15 is swivelably mounted in a bearing 16 which is fastened to the housing 12. The engaging lever 15 communicates with a guide ring 17. The guide ring 17 is displaceably mounted on a continuation 18 making up a component part of a roller-type overrunning clutch or freewheel 19. A meshing spring 20 is arranged on the circumferential surfaces of the continuation 18. The driving pinion 21 is associated with the roller-type freewheel 19. The roller-type freewheel 19 which makes up a component part of the starter motor 51 is arranged on a rotor shaft 22 so as to be displaceable in the longitudinal direction of the rotor shaft. A stop ring 23 is arranged on the rotor shaft 22 in such a way that the displaceability of the roller-type freewheel 19 is limited in the longitudinal direction of the rotor shaft, but such that it is possible for the driving pinion 21 to engage with the ring gear 6. A coarse thread 24 is worked into the surface of the rotor shaft, wherein a driver, not shown, of the roller-type freewheel 19 engages in the coarse thread 24. Further, an armature 25 is arranged on the rotor shaft 22. A commutator 26 on which are supported brushes 27 which are loaded by spring pressure is associated with the armature 25. The commutator 26 is conductively connected in a known manner with an armature winding 27. An excitation winding 29 which is arranged on a pole piece 30 is associated with the armature 25 at a distance referred to as air gap 28.

Further, bearings 31 are arranged in the housing 12 of the starter 3, wherein the rotor shaft 22 is mounted in the bearings 31 so as to be rotatable but substantially fixed with respect to axial displacement.

The control device 2 associated with the starter mechanism 1 communicates electrically with the starter 3 in such a way that it is connected in a conducting manner with the starter switch 4 on the one hand and with a contact 32 of the pull-in winding 9 and hold-in winding 53 on the other hand.

Figure 2:
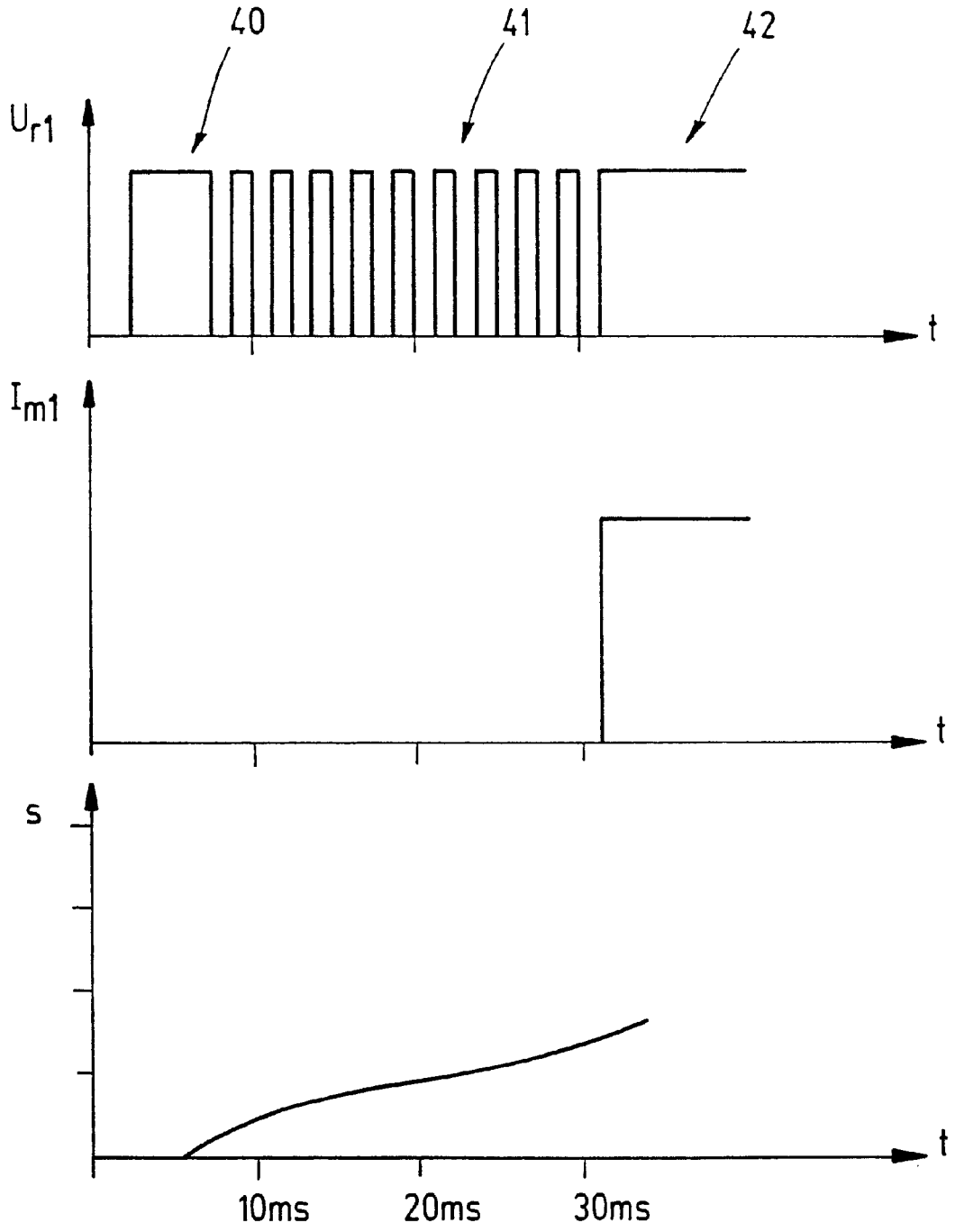
FIG. 2 shows a graphic representation of the axial path covered by the driving pinion, the motor current and the pulse-width modulated relay voltage over time, wherein the respective graph results in from the fact that the starter mechanism is operated with the circuit arrangement according to FIG. 1.

The graphic representation in FIG. 2 shows a qualitative curve of the relay voltage $U_{r1}$ over time t in the top graph, a qualitative curve of the motor current $I_{m1}$ over time in the middle graph, and the path s covered by the driving pinion 21 in the axial direction on the rotor shaft 22 depending on time in the bottom graph.

Figure 3:
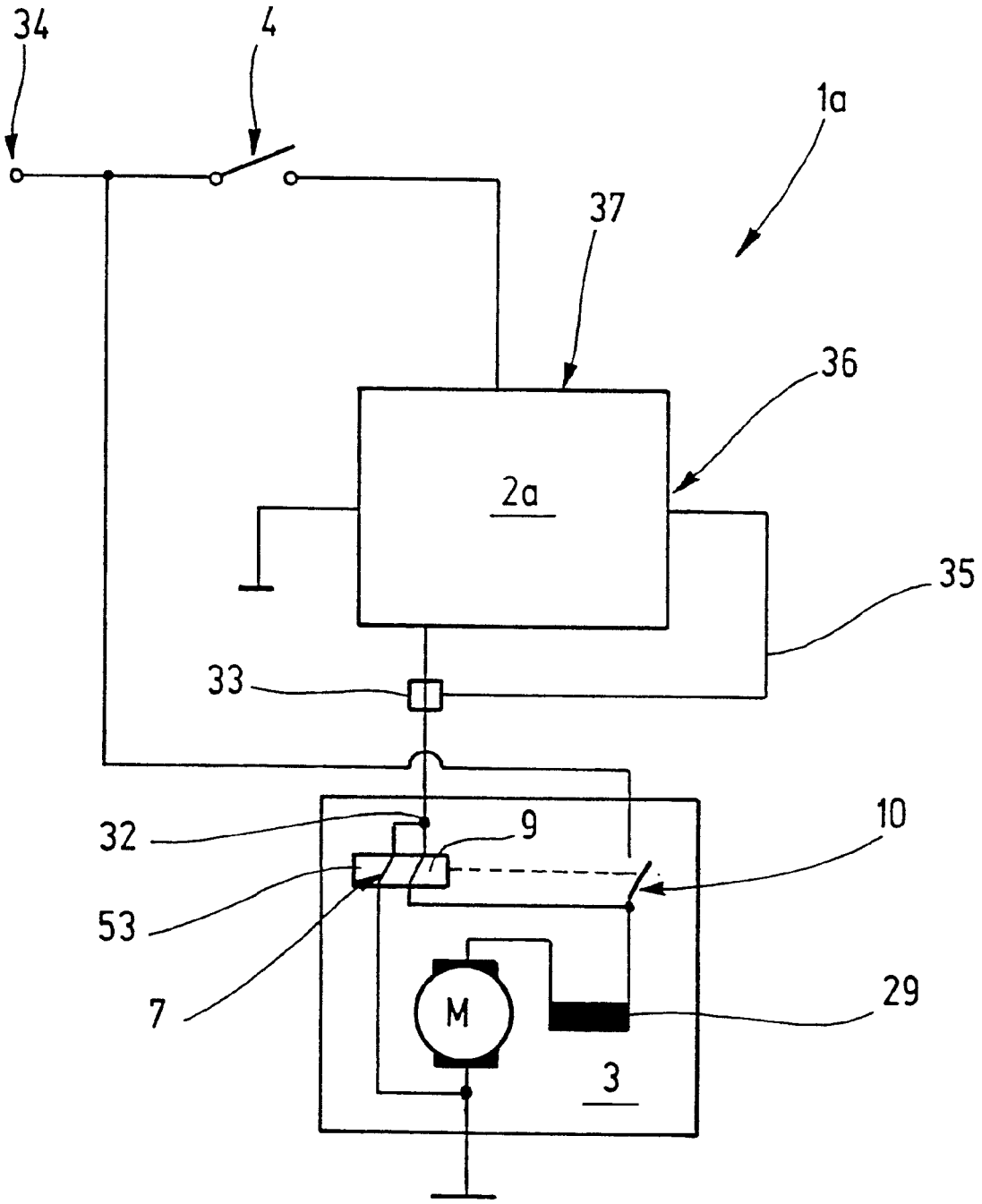
FIG. 3 shows a block diagram of a starter mechanism of an internal combustion engine connected with a second embodiment example of the circuit arrangement.

FIG. 3 shows the second embodiment example of the circuit arrangement according to the invention, wherein—as was already mentioned—the starter 3 is presented in the same embodiment form as in the first embodiment example; for this reason, its component parts are not described again and only the modifications of the circuit arrangement relative to embodiment example 1 are discussed.

FIG. 3 shows a starter mechanism 1*a* comprising a control device 2*a*, starter 3, starter switch 4, a battery terminal 34 and a current sensor 33.

The control device 2*a* is connected with the starter mechanism 1*a* like the control device 2 in FIG. 1 in that it communicates in an electrically conducting manner with the starter switch 4 on the one hand and with the relay contact 32 on the other hand. Further, a current sensor 33 is arranged between the electrical connection of the control device 2*a* and the relay contact 32. The current sensor 33 connected, via an electrical connection 35, with a feedback input 36 of the control device 2*a*. The control device 2*a* is constructed in this case as a dual-mode or two-step regulator 37.

Figure 4:
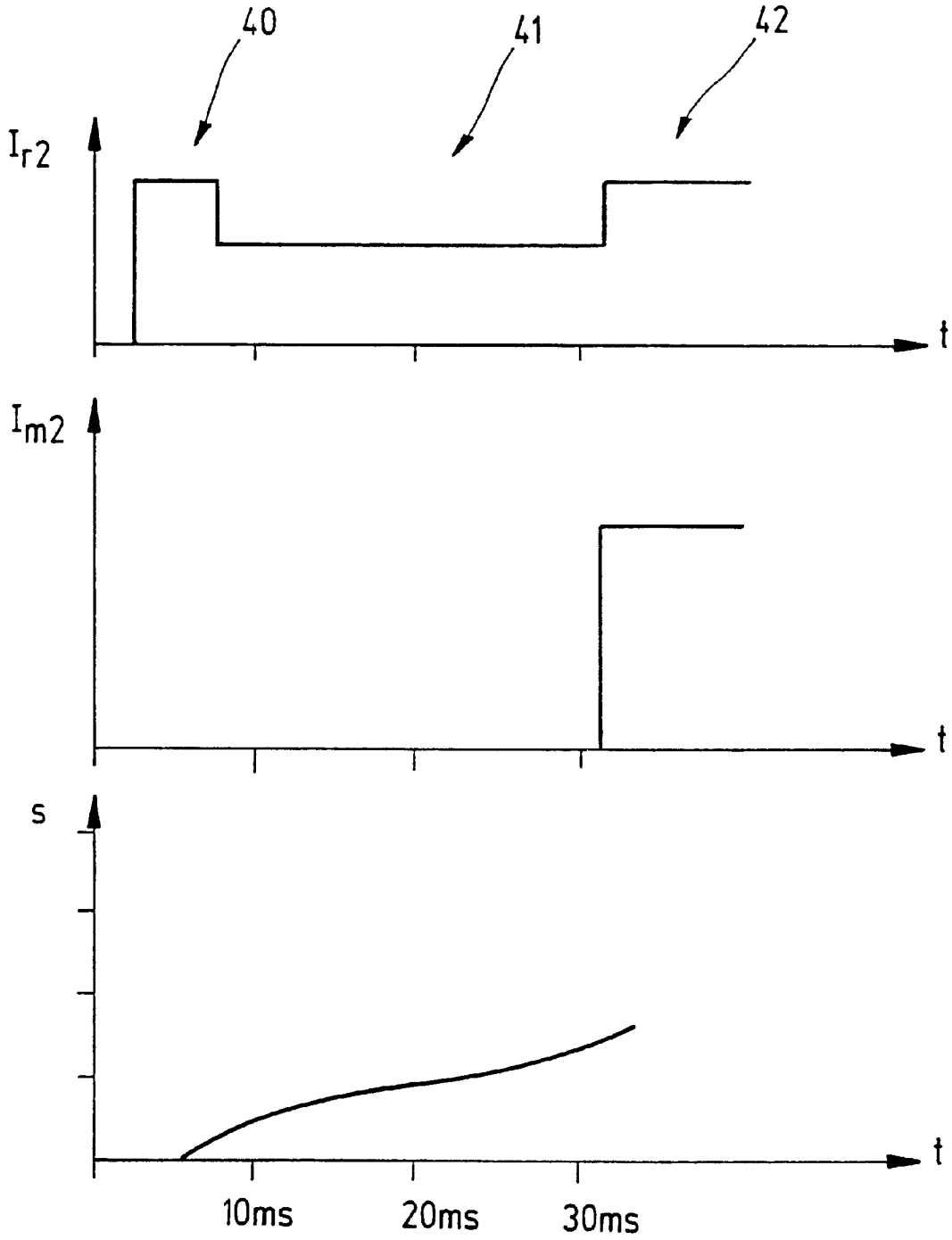
FIG. 4 shows a graphic representation of the axial path covered by the driving pinion, the motor current and the relay current over time, wherein the respective graph results from the fact that the starter mechanism is operated with the circuit arrangement according to FIG. 3.

The graphic representations in FIG. 4 show a qualitative curve of the relay current $I_{r2}$ depending on time t in the top graph, a time-dependent qualitative curve of the motor current $I_{m2}$ in the middle graph, and a qualitative curve of the axial pinion path s over time t in the bottom graph.

Figure 5:
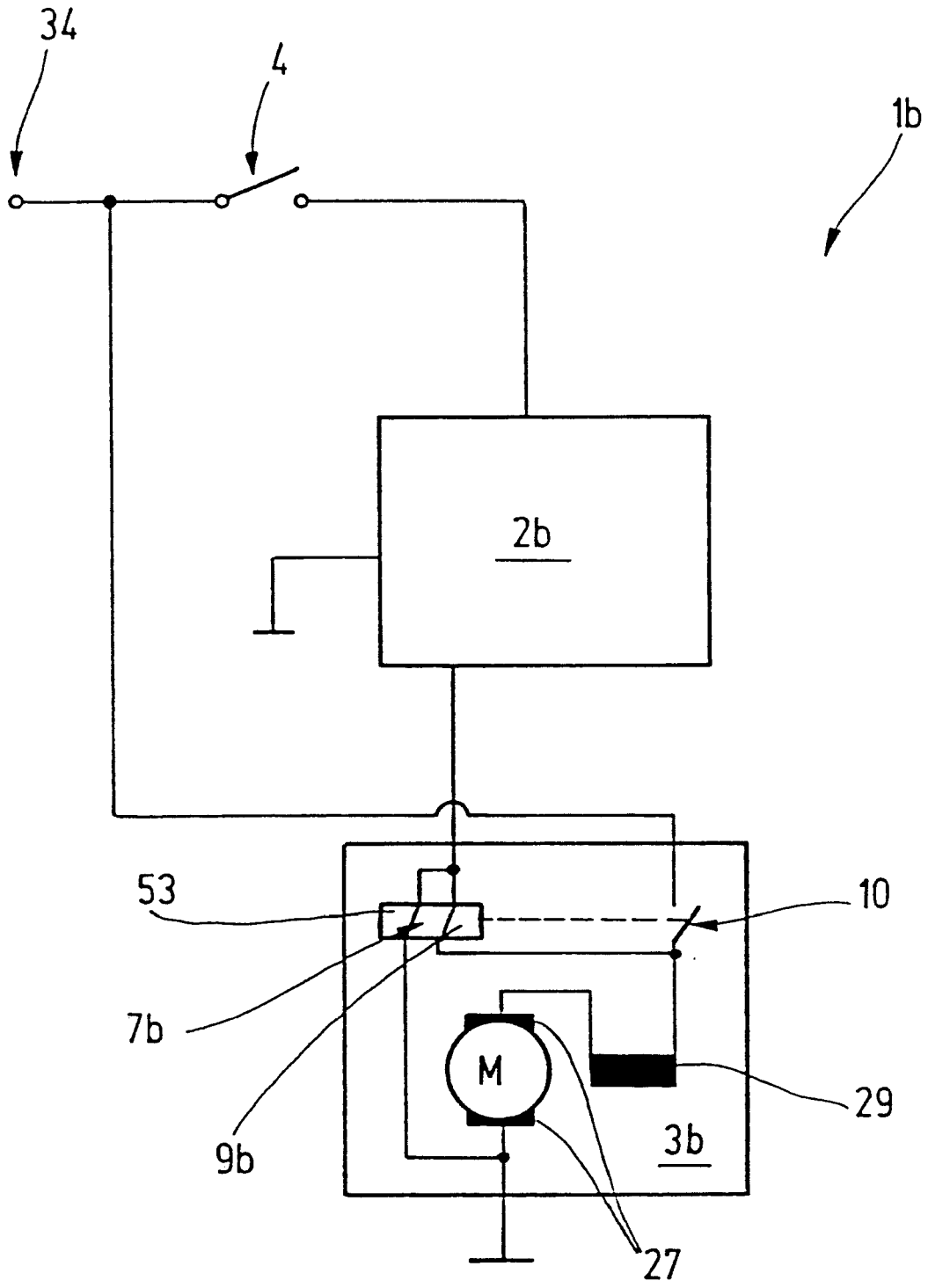
FIG. 5 shows a block diagram of a starter mechanism of an internal combustion engine connected with a third embodiment example of the circuit arrangement.

FIG. 5 shows a starter mechanism 1*b* with a third embodiment example of the circuit arrangement connected with a starter 3*b*, wherein the starter 3*b* has a modified engagement relay 7*b*. Further, the starter mechanism 1*b* in FIG. 5 has a starter switch 4, a control device 2*b* and a battery terminal 34.

The engagement relay 7*b* is modified relative to engagement relay 7 in FIG. 1 in that the number of turns of the pull-in winding 9*b* is reduced, but the conductor cross section of the pull-in winding 9*b* is increased. This results in an increased current requirement for the engagement relay 7*b* in order to apply the same force as that of engagement relay 7 from FIG. 1. The required current strength ranges, for example, from 100 A to 150 A. The control device 2*b* functions in the same manner as control device 2 from FIG. 1, but a final control stage, not shown, which is a component part of the control device 2*b* is constructed for increased current carrying capacity.

In the construction of the starter 3*b* shown in this case, a modification consists in that the meshing spring 20—as is shown in FIG. 1—can be dispensed with. This modification results from the function of the starter mechanism 1*b* which will be discussed further on.

Figure 6:
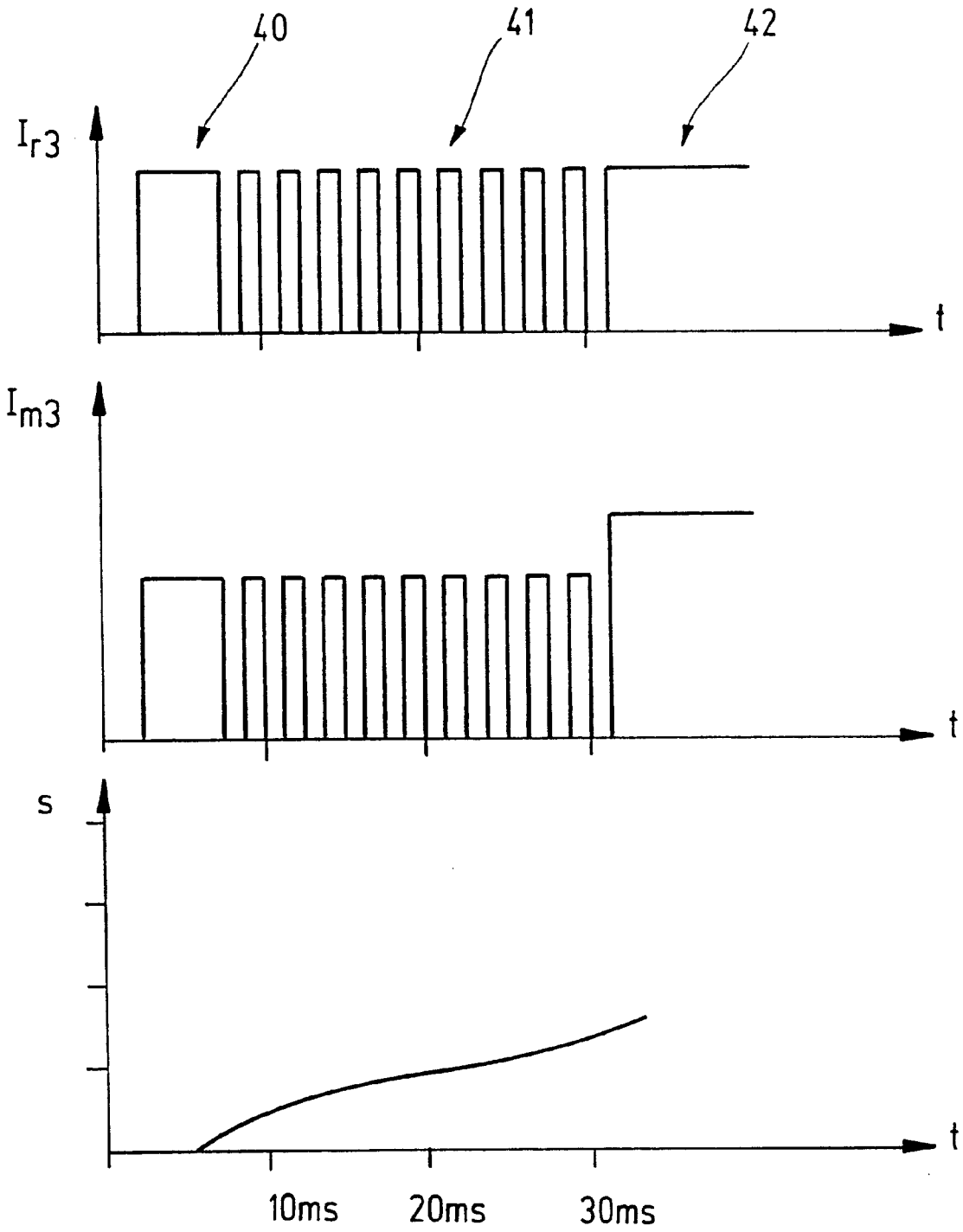
FIG. 6 shows a graphic representation of the axial path covered by the driving pinion, the motor current and the relay current over time, wherein the respective graph results from the fact that the starter mechanism is operated with the circuit arrangement according to FIG. 5.

The graphic representations shown in FIG. 6 show a qualitative curve of a relay current $I_{r3}$ as a function of time t in the top graph, a qualitative time-dependent curve of a motor current $I_{m3}$of the modified starter 3*b* from FIG. 5 in the middle graph, and a qualitative curve of the path s traveled by the driving pinion 21 of the starter 3*b* axially and in a time-dependent manner in the bottom graph.

Figure 7:
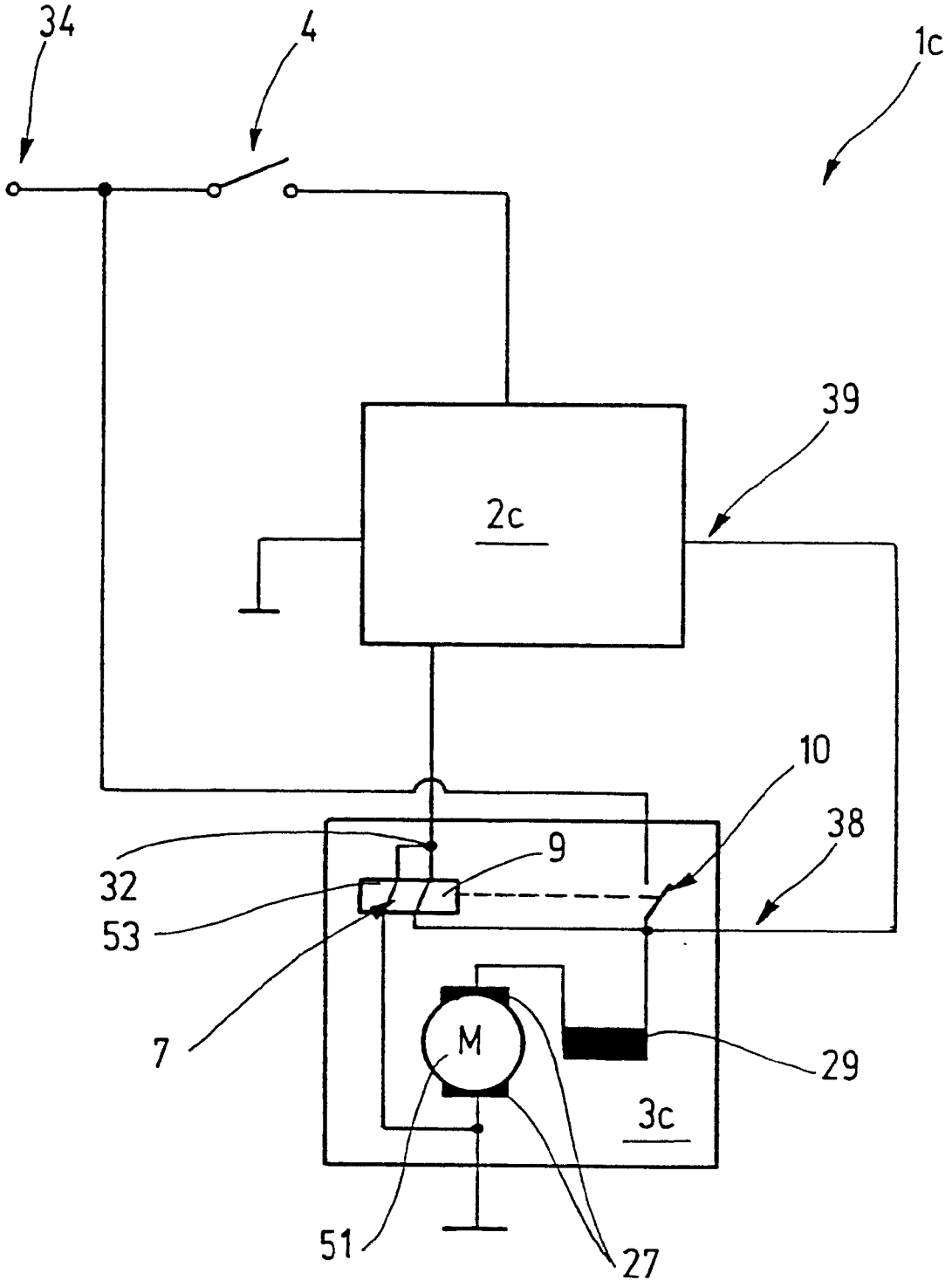
FIG. 7 shows a block diagram of a starter mechanism of an internal combustion engine connected with another embodiment example of the circuit arrangement.

FIG. 7 shows the fourth embodiment example of the circuit arrangement, according to the invention, of a starter mechanism 1*c* comprising a battery terminal 34, a starter switch 4, a control device 2*c* and a starter 3*c*.

Compared with the starter 3 from FIG. 1, starter 3*c* is modified in that the meshing spring 20—from FIG. 1—can advantageously be dispensed with. Further, the starter 3*c* has an additional connection 38 which is electrically connected with a second output 39 of the control device 2*c*. The second output 39 is a control output for the starter motor 51.

In other respects, reference is had to the component parts of the starter 3 from FIG. 1.

Figure 8:
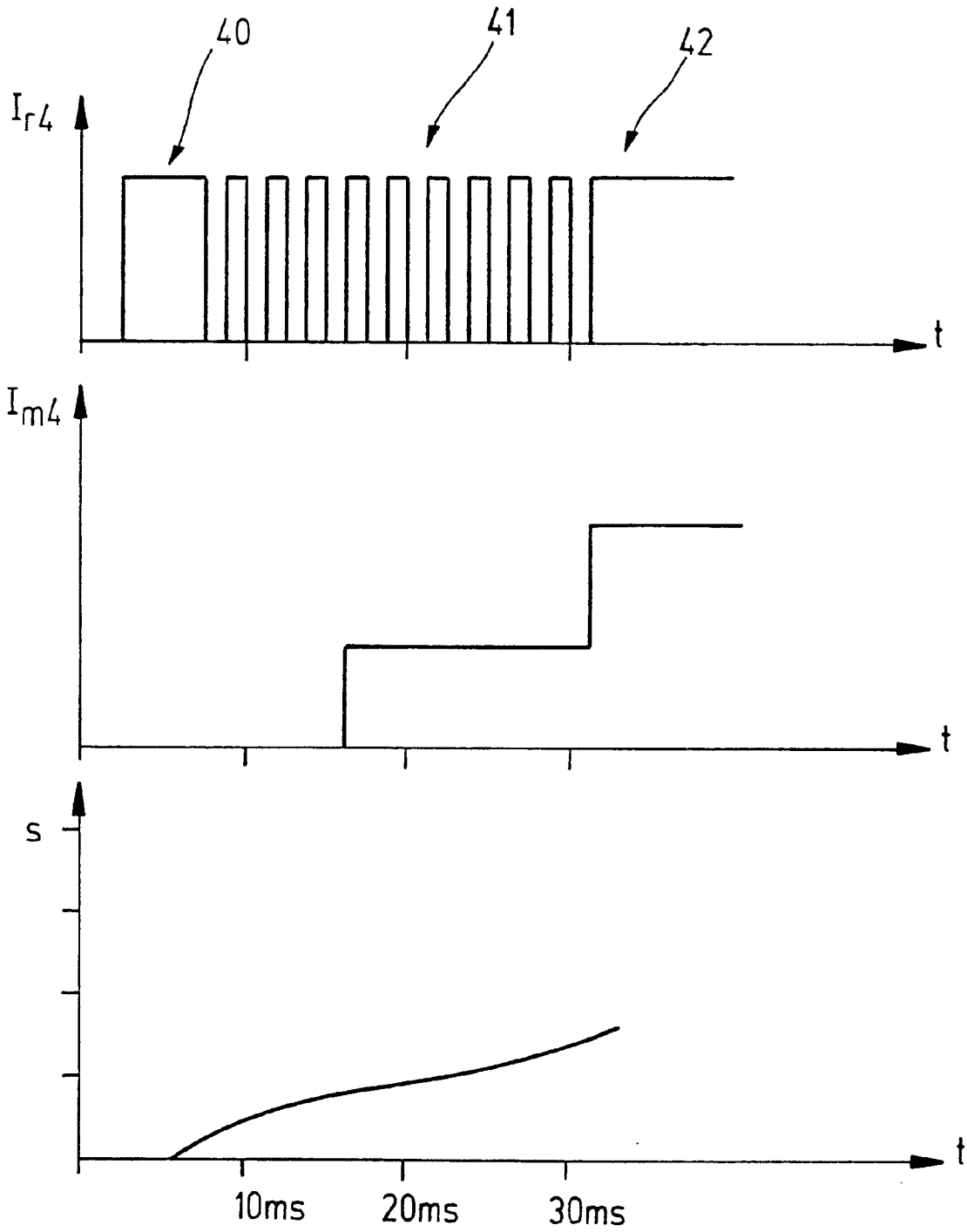
FIG. 8 shows a graphic representation of the axial path covered by the driving pinion, the motor current and the relay current over time, wherein the respective graph results from the fact that the starter mechanism is operated with the circuit arrangement according to FIG. 7.

The graphic representations in FIG. 8 show a qualitative curve of a relay current $I_{r4}$ as a function of time t in the top graph, a qualitative curve of a motor current $I_{m4}$ over time in the middle graph, and a time-dependent qualitative curve of the axial pinion path s in the bottom graph.

The manner of functioning associated therewith will be described hereinafter with reference to the embodiment examples.

When the starter switch 4 shown in FIG. 1 is actuated in the course of a desired starting process of the internal combustion engine, the battery voltage is applied to the control device 2 across the closed starter switch 4. The control device 2 supplies a control signal in pulse-width modulated form with a fixed clock frequency. The pulse-width ratio D indicating the switch-on period of a switching transistor in proportion to the clock cycle time within a clock period is set to "1" in a first time period 40 in the upper graph in FIG. 2. This means that the switch-on period corresponds to the cycle time of the clock frequency. In this first time period 40 in which the pulse-width ratio D=1, a switching transistor which is a component part of the control device 2 switches through the full battery voltage at the engagement relay 7, so that the relay current increases in accordance with the ohmic resistances and inductances through which it flows. Within this time period 40, the engagement relay 7 develops the full relay force needed, for example, at low outside air temperatures, for the "breaking free" of the relay armature 8 and for overcoming the adhesive friction and initial spring forces.

In this time period 40, the relay armature 8 moves to the right with reference to the drawing, that is, it is pulled into the pull-in winding 9 of the engagement relay 7. This process causes the engaging lever 15 to be swiveled about its bearing 16 in the clockwise direction so that the engaging lever 15 moves the roller-type freewheel 19 together with the driving pinion 21 to the left with reference to the drawing, that is, in the direction of the ring gear 6, by means of the guide ring 17. This results in a traveled path s for the driving pinion 21 as is shown in a time-dependent manner in FIG. 2 in the bottom graph.

There follows a second time period 41 during which the pulse-width ratio D is reduced to a value of less than 1, so that the relay current decreases to a value which is less than the relay current in the first time period 40.

In this time period 41, the relay armature 8 is drawn into the pull-in winding 9 of the engagement relay 7 with reduced force, so that the driving pinion 21 approaches the ring gear 6 at reduced speed. The duration of the second time period 41 must be long enough so that the driving pinion 21 reaches the ring gear 6 in every case. The relay armature 8 of the engagement relay 7 is pulled into the pull-in winding 9 to a depth such that it closes the contact bridge 10 via a rod linkage which is shown in dashed lines in FIG. 1 and which communicates mechanically with the contact bridge 10, so that there is a conducting connection between the battery 5 and the excitation winding 29. At the same time, the hold-in winding 53 is switched on across the closed contact bridge 10 and the pull-in winding 9 is short-circuited.

The rotating movement of the armature 25 is brought about by the motor current $I_{m1}$ flowing across the contact bridge 10, so that the rotating movement of the armature 25 is transmitted to the ring gear 6 via the rotor shaft 22 and the driving pinion 21. At the same time that the armature 25 begins its rotating movement, the pulse-width ratio D within the control device 2 is again set to D=1 in a third time period 42. In this way, the engagement relay 7 can again deploy its full force, so that the driving pinion 21 remains reliably engaged with the ring gear 6.

If a driving pinion position which does not allow the driving pinion 21 to mesh with the ring gear 6 occurs during the meshing process—for example, if two teeth of the gearwheel elements directly face one another—the spring force of the meshing spring 20 is overcome by the movement of the engaging lever 15 toward the left and the driving pinion is set in rotation via the meshing gear unit 52. This is carried out by a movement of the guide ring 17 toward the left in conjunction with the driver, not shown, which engages in the coarse thread 24, so that the rotating movement of the driving pinion 21 is carried out in the manner described above and a meshing of the driving pinion 21 with the ring gear 6 is made possible.

Once the starting process of the internal combustion engine has been concluded, that is, when no torque is transmitted from the starter 3 to the gearwheel 6, torque is transmitted from the ring gear 6 to the driving pinion 21, the driving pinion 21 is de-meshed again via the roller-type freewheel 19 in a manner known from the prior art. A torque transmission from the ring gear 6 to the driving pinion 21 is carried out when the speed of the internal combustion engine is greater than that of the starter motor 51. After the starting process, all mechanical elements which were swiveled or moved for the starting process return again to their original positions and the motor current and relay current are switched off. The relay current is switched off by the starter switch 4 so that the engagement relay 7 drops and the contact bridge 10 opens.

With respect to the mechanical components of the starter 3, the embodiment example of the circuit arrangement shown in FIG. 3 has the same operating sequence as the starter 3 shown in FIG. 1. For this reason, only the manner of operation of the control device 2*a* will be described.

For the desired starting process, the starter switch 4 is closed, so that a conducting connection is produced between the battery—represented by battery terminal 34—and the control device 2*a*. In contrast to the control device 2 in FIG. 1, the relay current $I_{r2}$ is not changed by the pulse-width modulated relay voltage, but rather through a two-step regulator 37 which is used in this case and known from the prior art.

The two-step regulator 37 makes it possible to adjust the relay current $I_{r2}$ to two values. In this way, it is possible in an advantageous manner for the two-step regulator 37 to detect the value of current given by the control device 2*a* by means of a current sensor 33, which is connected with the feedback input of the two-step regulator 37 via an electrical connection line 35, and to adapt the actual value to the reference value of the current $I_{r2}$.

The relay current $I_{r2}$ is shown in the top diagram in FIG. 4. A current which results in a compulsory manner in accordance with the battery voltage applied to the engagement relay 7 depending on the ohmic resistances and inductances is adjusted for the starting process in the first time period 40. The engagement relay 7 develops the force needed for the breaking free of the relay armature 8.

During the second time period which now follows, the two-step regulator 37 reduces the relay current $I_{r2}$ to a lower value. When the driving pinion 21 is completely meshed in the ring gear 6, the third time period 42 begins, during which the two-step regulator 37 raises the relay current $I_{r2}$ again to the increased value. At the same time, the motor current $I_{m2}$ is switched on via the contact bridge 10 when the third time period begins, so that the actual starting process of the internal combustion engine takes place.

In the event of a tooth-to-tooth position, as was already described in the first embodiment example, a mechanical rotation of the driving pinion is carried out similar to the first embodiment example.

When the starting process is concluded, the driving pinion 21 is de-meshed from the ring gear 6 in a known manner, wherein all of the mechanical components of the starter 3 are returned to their initial position. The motor current and the relay current are accordingly switched off as in the first embodiment example.

The operation of the third embodiment example is described in the following with reference to FIG. 5.

A modified starter 3*b* is used for the third embodiment example of the circuit arrangement 2.

The modification of the starter 3*b* consists in that the pull-in winding 9*b* of the engagement relay 7*b* is changed in such a way that the same force-path characteristic as that in an engagement relay 7 according to FIG. 1 is ensured, but a higher current strength of the relay current $I_{r3}$ is needed for this purpose. As was already mentioned, this is carried out by reducing the number of turns of the pull-in winding 9*b* accompanied by a simultaneous increase in the conductor cross section.

As in the preceding embodiment examples, the pull-in winding 9*b* is connected in series in the same manner with the excitation winding 29 and armature winding 27. Due to the increased current requirement of the engagement relay 7*b*, which also flows across the engagement relay 7*b* and armature windings 27 in accordance with the circuit, it is advantageously possible that the armature of the starter 3*b* rotates at a sharply reduced speed during the meshing process of the driving pinion 21 in the ring gear 6. As a result of this advantageous construction, the meshing spring 20 which is shown in FIG. 1 is dispensed with in this third embodiment example; the coarse thread 24 may also be omitted, that is, the meshing gear unit 52 can be dispensed with. However, in so doing, it must be ensured that the driving pinion 21 continues to be axially displaceable on the rotor shaft 22, but suitable steps must be taken so that the driving pinion 21 compulsorily rotates along with the armature.

In order to be able to realize this embodiment example in practice, the final control stage, not shown, of the control device 2*b* must be constructed with increased current carrying capacity.

In accordance with the preceding description, this third embodiment example operates in such a way that the engagement relay 7*b* is actuated in a known manner when the starter switch 4 is actuated, so that the axial movement of the driving pinion 21 is carried out. The meshing of the driving pinion 21 in the ring gear 6 in the event of a tooth-to-tooth position is then made possible in that the armature 25 of the starter 3*b* rotates at reduced speed during time periods 40 and 41 by means of the relay current $I_{r3}$ supplied via the control device 2*b*. After the driving pinion 21 is fully engaged with the ring gear 6 and the relay armature 8 is completely drawn into the pull-in winding 9*b*, the contact bridge 10 is closed by means of the mechanical connection—shown in dashed lines—to the engagement relay 7. As the contact bridge 10 closes, the third time period 42 begins. Full battery voltage is applied to the excitation winding 29 and the armature winding 27 via the contact bridge 10, so that the motor current $I_{m3}$ can increase to its nominal value.

Due to the nominal current of the motor in the third time period, the driving pinion 21 rotates at the speed necessary for starting an internal combustion engine, not shown, via the ring gear 6.

At the conclusion of the starting process, the driving pinion 21 is de-meshed through the roller-type freewheel in a known manner. In this case, as was already mentioned, the mechanical components are returned to their initial position and the relay current and motor current are switched off.

The fourth embodiment example of the circuit arrangement shown in FIG. 7 differs from the first embodiment example according to FIG. 1 in that the control device 2*c* is expanded and the starter 3*c* is modified.

The starter 3*c* has a connection 38 which forms a bypass to the contact bridge 10 in connection with the additional output 39 of the control device 2*c*, wherein the connection 38 is a component part of the contact bridge 10, so that advantageously no additional terminal is needed at the starter 3*c*. Inside the control device 2*c*, the output 39 communicates with another final control stage which is decoupled from the output driving the engagement relay 7.

As an advantageous result, the starter mechanism 1*c* operates in such a way that the engagement relay 7 is supplied with current by closing the starter switch 4, so that the engagement process of the driving pinion 21 in the ring gear 6 is initiated. The excitation winding 29 and the armature windings 27 are supplied with current by means of the additional final control stage of the control device 2*c*. The motor current $I_{m4}$ provided via the additional final control stage at the output 39 of the control device 2*c* brings about a rotating movement of the armature 25 at reduced speed.

FIG. 8 shows a curve for the motor current $I_{m4}$ according to the above-mentioned type. It will be seen that during the first time period 40 the engagement relay 7 is supplied with current in a known manner, but the starter motor remains switched off. It is only during the second time period 41 while the engagement relay 7 is operated at reduced output that a low motor current $I_{m4}$ is supplied by the control device 2*c*. After the driving pinion 21 engages with the ring gear 6, the motor current $I_{m4}$ is increased at the start of the third time period 42 by closing the contact bridge 10, so that the armature 25 rotates at nominal speed, wherein the driving pinion 21 arranged on the rotor shaft 22 drives the ring gear 6 at the speed of the rotor.

When the starting process is concluded, the driving pinion 21 is de-meshed from the ring gear 6 in a known manner, all mechanical components move back into their initial position, and the relay current and motor current are switched off.

It is clear that the circuit arrangement in the fourth embodiment example makes it possible not only to decouple the axial and rotational movement of the driving pinion 21 with respect to time but also with respect to force.

Accordingly, it is advantageously possible to apply a high axial force by means of the engagement relay 7 for engaging the driving pinion 21 in the ring gear 6 and, at the same time, to reduce the driving torque of the armature 25 by reducing the motor current $I_{m4}$. Accordingly, it is possible to reduce wear between the driving pinion 21 and ring gear 6 to a minimum.

In summary, it is noted that the first and second embodiment examples differ only in that the supply of current is different, wherein the relay voltage in the first embodiment example is pulse-width modulated and in the second embodiment example the relay current can be influenced by the two-step regulator.

A modified embodiment form of the starter is provided for the third and fourth embodiment examples. The control devices 2*b* and 2*c* also differ from one another. The control device 2*b* is characterized by an increased current carrying capacity of the final control stage, whereas the control device 2*b* has an additional final control stage for supplying current to the starter motor.

However, it is expressly noted that the control devices in the third and fourth embodiment examples provide either a pulse-width modulated relay voltage or a current which can be influenced by a two-step regulator. A combination of the two supplied current variants is also possible for the fourth embodiment example.

Further, a device which regulates or controls the relay and/or motor current depending on state is also possible. State variables such as these may be, for example, the engagement relay temperature or the temperature of the armature winding.

The four embodiment examples mentioned herein can contain a delay circuit, not shown. This delay circuit makes it possible to block the starter mechanism after a false start of the internal combustion engine, so that it is ensured prior to a further starting process that the driving pinion 21 and ring gear 6 are no longer in rotation.

Finally, it will be seen that the circuit arrangement according to the invention is suitable for minimizing wear on the driving pinion 21 and ring gear 6, so that the life of the starter mechanism is increased five- to ten-fold. At the same time, the circuit arrangement enables a noise reduction during the meshing of the driving pinion 21 in the ring gear 6 because grinding is prevented.

A substantial advantage of the circuit arrangement according to the invention results from the fact that there is no need to carry out any substantial mechanical modifications of the starter.

What is claimed is:

1. A circuit arrangement for an engagement relay of a starter mechanism of an internal combustion engine, for bringing two gearwheels in engagement, said circuit arrangement comprising a switching element which reduces a relay current after a first time period before meshing of the two gear wheels to a determined current value during a second time period, said switching element being formed as a controlling and regulating device which increases a relay current to a predetermined value to a third time period which starts when one gear wheel reaches the other gear wheel.

2. A circuit arrangement as defined in claim 1, wherein said controlling and regulating device include a current sensor which detects the relay current.

3. A circuit arrangement as defined in claim 2, wherein said controlling and regulating device is formed so that it regulates the relay current depending on a measurement signal of said current sensor.

4. A circuit arrangement as defined in claim 3, wherein said controlling and regulating device regulates the relay current by a two-step regulator.

5. A circuit arrangement as defined in claim 1; and further comprising means for connecting the engagement relay in series with a winding of a starter motor selected from the group consisting of an armature winding and an exditation winding, which is activated at low output at least in a time period selected from the group consisting of said second period and said third period by the relay current.

6. A circuit arrangement as defined in claim 1, wherein said controlling and regulating device is formed so that it activates a starter motor at least in a time period selected from the group consisting of said second time period and said third time period.

7. A circuit arrangement as defined in claim 1; and further comprising means for pulse-width modulation of a control signal which is sent by said controlling and regulating device to the engagement relay.

8. A circuit arrangement as defined in claim 7; and further comprising means for carrying out a decrease in the relay current by changing a duty factor of the control signal.

9. A circuit arrangement as defined in claim 1; and further comprising a meshing arrangement which rotates one of the two gear wheels relative to the other at low speed at least in a time period selected from the group consisting of the second time period and the third time period.

10. A circuit arrangement as defined in claim 1, wherein said controlling and regulating device includes a timing element which prevents a restarting of the starter mechanism before an expiration of a given period of time following a most recent start.

11. A circuit arrangement as defined in claim 1, wherein said controlling and regulating device is formed so that it regulates the relay current depending on determined state variables.

* * * * *